US011131110B1

(12) United States Patent
Sternowski et al.

(10) Patent No.: US 11,131,110 B1
(45) Date of Patent: Sep. 28, 2021

(54) PORTABLE SUPPORT MAST

(71) Applicant: Softronics Ltd., Marion, IA (US)

(72) Inventors: Robert H. Sternowski, Cedar Rapids, IA (US); Dave Pearson, Palo, IA (US)

(73) Assignee: SOFTRONTCS LTD., Marion, IA (US)

( * ) Notice: Subject to any disclaimer, the term of this patent is extended or adjusted under 35 U.S.C. 154(b) by 0 days.

(21) Appl. No.: 17/323,803

(22) Filed: May 18, 2021

Related U.S. Application Data

(60) Provisional application No. 63/162,212, filed on Mar. 17, 2021.

(51) Int. Cl.
*E04H 12/18* (2006.01)
*E04H 12/20* (2006.01)

(52) U.S. Cl.
CPC ..... *E04H 12/187* (2013.01); *E04H 12/182* (2013.01); *E04H 12/20* (2013.01)

(58) Field of Classification Search
CPC ..... E04H 12/187; E04H 12/182; E04H 12/20; E04H 12/18; E04H 12/2238; E04H 12/345; H01Q 1/1235; F16G 11/12
USPC ..... 52/118, 651.07; 24/71.1
See application file for complete search history.

(56) References Cited

U.S. PATENT DOCUMENTS 1,954,768 A * 4/1934 Krakauer ..... A41F 15/002 2/323
2,576,986 A * 12/1951 Windsor ..... B65D 63/16 24/68 A
2,832,555 A * 4/1958 Terhune ..... H01Q 1/1235 248/170
2,865,600 A * 12/1958 Roebling ..... F16G 11/12 24/71.1
3,173,642 A * 3/1965 Sidneya ..... G10G 5/00 248/170
3,302,345 A * 2/1967 Ballantine ..... E04H 12/182 52/121
4,377,886 A * 3/1983 Golden ..... F16G 11/12 24/68 CD
4,569,499 A * 2/1986 Seely ..... G09F 7/22 248/160

(Continued)

FOREIGN PATENT DOCUMENTS

EP 0009451 A1 * 4/1980 ..... E04H 12/20
GB 2130417 A * 5/1984 ..... E01F 9/688

OTHER PUBLICATIONS

HeroAir Water-Fed Poles—https://usa.windows101.com/collections/heroair, Aug. 4, 2021.

(Continued)

*Primary Examiner* — Brent W Herring
(74) *Attorney, Agent, or Firm* — Shuttleworth & Ingersoll, PLC; Jason R. Sytsma

(57) ABSTRACT

A hub, an extensible vertical member pivotally attached to the hub for movement between a stowed position and an erect position, and at least three extensible horizontal members each pivotally attached to the hub for movement between a stowed position and an erect position. The vertical member and the horizontal members are each extensible such that a ratio of the extensible length of the vertical member to the extensible length of the horizontal members is adjustable for required stability in high wind applications.

15 Claims, 4 Drawing Sheets

(56) References Cited

U.S. PATENT DOCUMENTS 4,593,879 A * 6/1986 Seely ..... G09F 7/22 248/160
4,612,686 A * 9/1986 Bowers ..... B60P 7/0838 24/71.1
4,625,475 A * 12/1986 McGinnis ..... H01Q 1/1235 242/390.2
4,691,892 A * 9/1987 Grewe ..... G09F 7/22 248/160
4,951,407 A * 8/1990 Werner ..... G09F 7/22 248/160
5,121,890 A * 6/1992 Komada ..... A47F 7/00 248/122.1
6,695,268 B1 * 2/2004 Hsieh ..... A47B 19/002 248/188.7
8,181,918 B2 * 5/2012 McCloud ..... A61M 16/0875 248/81
8,590,190 B2 * 11/2013 White ..... F21V 21/06 40/612
9,305,475 B2 * 4/2016 White ..... F21L 4/08
9,816,661 B2 * 11/2017 Sharrah ..... F21S 9/02
10,634,327 B2 * 4/2020 Cornell ..... F21V 21/06
2003/0107525 A1 * 6/2003 Ehrenberg ..... H01Q 1/1235 343/881
2008/0141918 A1 * 6/2008 McClintock ..... B63B 15/02 114/90
2009/0284963 A1 * 11/2009 Intravatola ..... F16M 11/42 362/190
2010/0019107 A1 * 1/2010 McCloud ..... A61M 16/0875 248/83
2012/0204469 A1 * 8/2012 Kowalski ..... A01K 97/10 43/17.5
2014/0014807 A1 * 1/2014 Kamm ..... F16M 11/32 248/558
2014/0238747 A1 * 8/2014 Fabian ..... E21B 10/44 175/57
2015/0152998 A1 * 6/2015 Intravatola ..... F21V 17/007 248/528
2015/0192243 A1 * 7/2015 Sharrah ..... F21L 4/00 362/190
2015/0330558 A1 * 11/2015 Intravatola ..... F16M 11/28 362/184
2018/0106418 A1 * 4/2018 Anglin ..... F16M 13/00
2019/0292804 A1 * 9/2019 Kensinger ..... E04H 12/20

OTHER PUBLICATIONS

Hero Air 35ft/10.6m Carbon Fiber Waterfed Pole—Master Pole—https://usa.windows101.com/collections/heroair/products/hero-air-35ft-10-6m-carbon-fiber-waterfed-pole-master-pole, Aug. 4, 2021.

* cited by examiner

PORTABLE SUPPORT MAST

CROSS-REFERENCE TO RELATED APPLICATIONS

The present application claims the benefit of U.S. Provisional application Ser. No. 63/162,212 filed Mar. 17, 2021, which is incorporated herein by reference.

TECHNICAL FIELD

This disclosure relates to a support structure that holds an object in a fixed position above the ground, and more specifically, this disclosure is directed to a support mast that can be rapidly and easily deployed for holding an object above the ground.

BACKGROUND INFORMATION

Supporting structures fall into one of two broad categories: Permanent and portable/temporary. Permanent structures are by nature more massive, capable of supporting large loads, and require a lengthy erection process. The disclosed invention relates primarily to portable/temporary structures, where a lighter weight object must be supported for a limited period of time. It is generally desirable to be able to erect such a supporting structure with the fewest number of persons working on it (due to the cost of labor) in the shortest period of time. Such a structure must also be carried within the physical weight carrying limits imposed by government regulations, as well as safety standards related to the erection process. Portable structures typically have heights in the range of 15 to 35 feet, although some may be larger depending upon the design.

Prior art in portable supporting structures may be further subdivided into person-carried and transportable varieties. The transportable structures are typically too massive to be moved or carried by one or more persons, instead requiring some sort of wheeled conveyance. Person-carried structures is the application group targeted by the disclosed invention. By nature, such structures are light enough to be carried without mechanical assistance.

Erection of person-carried portable support structures classically fall into one of several means, two of which include "crank up" and "walk up". A crank up structure includes a complex system of pullies and cables (or similar) mechanical assistance scheme allowing extension of the vertical support member from a single point at the base. The vertical member must generally be guyed while erecting it to avoid it falling over and breaking.

A walk up support structure, with antenna and feedline, is fully assembled and extended lying flat on the ground, and then gradually manually lifted to the vertical position by one or more persons pushing upward on the structure starting at the top end and gradually "walking" toward the pivot point while pushing upward, while other persons hold the pivot point steady and provide tension on the guy lines to keep it from falling to the ground laterally. Optionally, an "X" shaped structure may be inserted under the top end of the structure and gradually moved toward the pivot point, letting the "X" support the structure's weight instead of the erection crew.

While the crank-up scheme appears to be the most attractive, its complexity adds significant cost and weight such that existing systems are generally too heavy for person-carry. They also require multiple persons to maintain tension on each of (typically) three or four guy lines, in addition to the person cranking up the vertical member. Anchoring the guy lines generally requires measuring and driving stakes into the ground at accurate points, and requires limiting the choice of structure locations to those with ground types conducive to driving a stake into (e.g., unpaved, not rocky, not swampy, not sand, etc.). Driving guy stakes into the ground also requires time and physical exertion.

The walk-up scheme is the simplest scheme, given that the weight of the structure and top mounted object are within a reasonable weight range. The walk-up scheme, however, suffers from the same need for multi-person guy line attendants and need to accurately survey and stake the guy lines as with the crank-up scheme. The walk-up scheme also suffers from low-modulus mast structures, meaning that as the mast is walked up, the vertical structure bows as it rises due to its own weight. Assuming that the bowing does not bend or break it, when the structure reaches a critical zenith angle relative to vertical, it abruptly springs forward in the direction in which it is being raised. That sudden springing forward causes a back-and-forth oscillation in the vertical plane in which it is being raised that, unless damped by the two opposing guy line attendants, will cause the structure and top object to break or fall to the ground, with resulting damage and personnel injuries.

Prior art structures are typically made from aluminum or fiberglass, both of which have substantial weight and low modulus. Walkup masts typically have telescoping sections with clamps, or swaged sections that fit together. Other sectional joining schemes may also be found (hinges, fastener/flange, slit/hose clamp, etc.).

Accordingly, there is a need for an innovative apparatus that resolves the limitations of prior art.

SUMMARY

In accordance with one aspect of the present invention, a portable support mast is disclosed. The portable support mast comprises of a hub, an extensible vertical member pivotally attached to the hub for movement between a stowed position and an erect position, and at least three extensible horizontal members each pivotally attached to the hub for movement between a stowed position and an erect position. The vertical member and the horizontal members are each extensible such that a ratio of the extensible length of the vertical member to the extensible length of the horizontal members is adjustable for required stability in high wind applications.

In an embodiment, the portable support mast comprises of a pivot joint positioned between the hub and the extensible vertical member. The hub comprises of a top surface, an opposite bottom surface, and a side surface, wherein the pivot joint is attached to the side surface of the hub. A limiting brace can be attached to the top surface of the hub and positioned to support the extensible vertical member in the erect position which is substantially perpendicular to the top surface of the hub. The limiting brace can prevent the extensible vertical member from pivoting past the erect position.

Pivot joints can be provided between the hub and each one of the extensible horizontal members. A limiting brace can be attached to the top surface of the hub and positioned to limit the movement of the extensible horizontal members in the erect position which is substantially parallel to the top surface of the hub. The hub can enable the vertical member and horizontal members to pivot from a stowed position where they all hang parallel to each other for convenience of transport, and wherein the horizontal members pivot to the erect position, and wherein the vertical member pivots substantially 180 degrees to the erect position.

In an embodiment, the vertical member and the horizontal members can be configured with telescoping sub-members to extend their respective length. A compression clamp which constricts an outer one of two telescoping sub-members to an inner one of two telescoping sub-members can also be provided to make the length easily adjustable. Each horizontal member can comprise of an anchor on an end opposite of the hub and an anchor on an end opposite of the hub for attaching a guy line between the anchor on the vertical member and the anchor on the one of the horizontal members. The guy line can comprise indications thereon and each of the horizontal members further comprises indications thereon corresponding in distance of separation with a distance of separation of the indications on the guy line to allow the guy line to be attached between the horizontal member and the vertical member before the vertical member is pivoted to the erect position.

The vertical member and the horizontal member can comprise any material but carbon material can provide a light weight yet sturdy structure. Once erected the portable support mast can be used to elevate any object, but is particularly suitable for elevating an antenna above the ground.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The drawings show a support mast for any object, but especially useful for a radio antenna, where the line of sight coverage radius of a radio signal is proportional to the square root of the antenna distance above ground. It will be obvious, however, that the disclosed structure is equally useful for supporting a wide variety of other objects needing to be elevated above the ground (i.e., security devices, cameras, scientific instruments, etc.).

Figure 1:
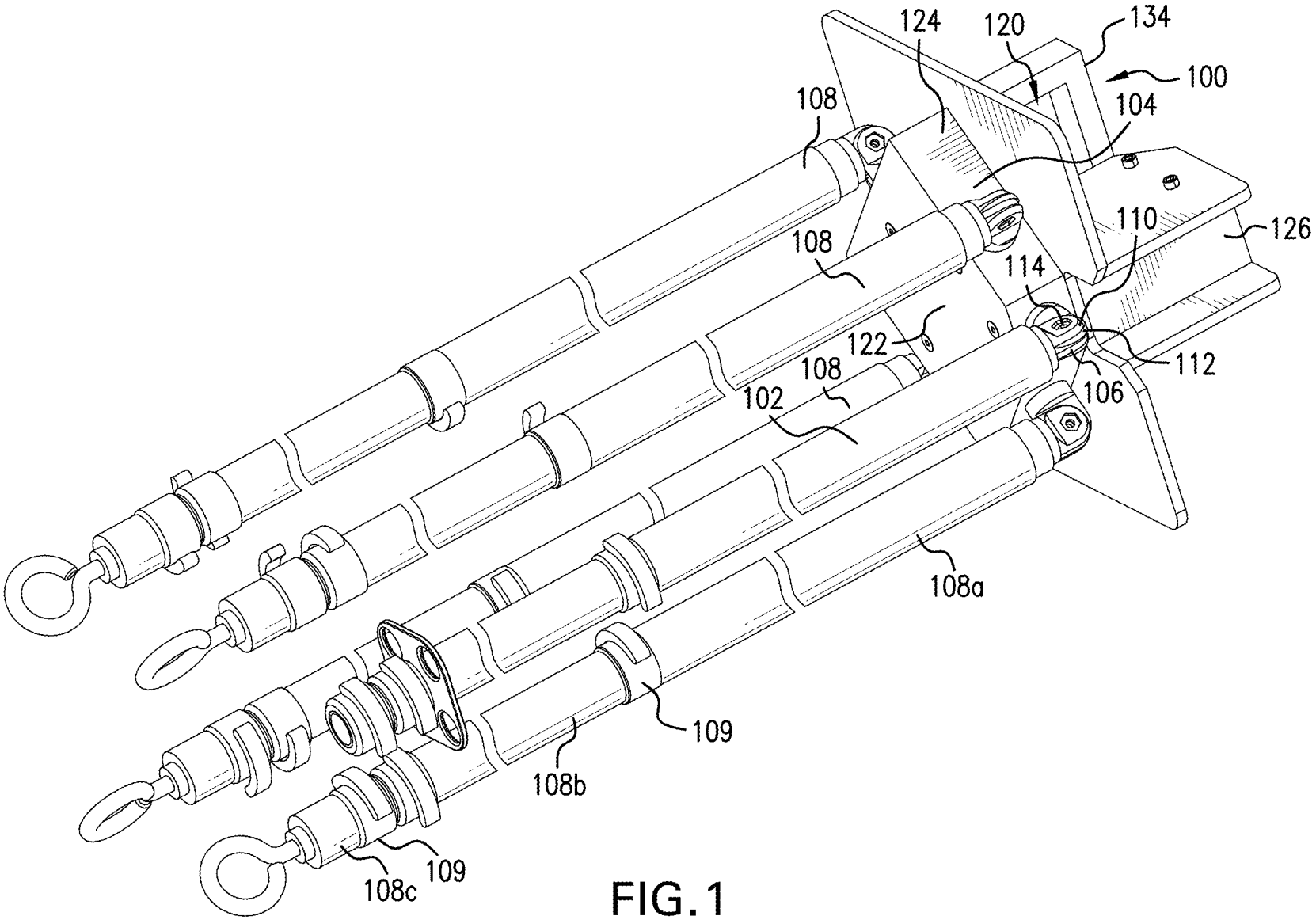
FIG. 1 is an illustration of a portable support mast in a stowed position according to this disclosure.
Figure 2:
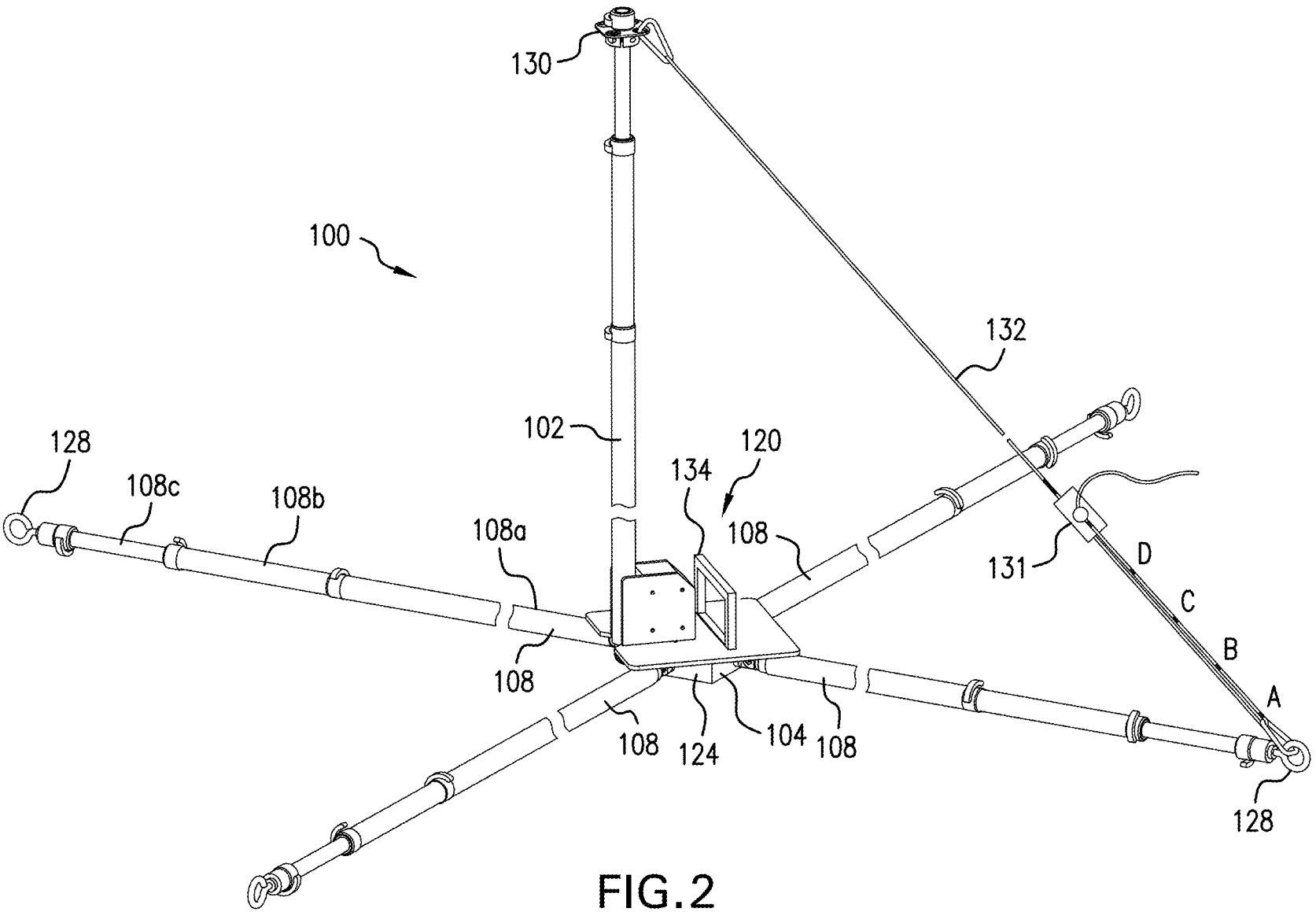
FIG. 2 is an illustration of the portable support mast of FIG. 1 in the erect position.
Figure 3:
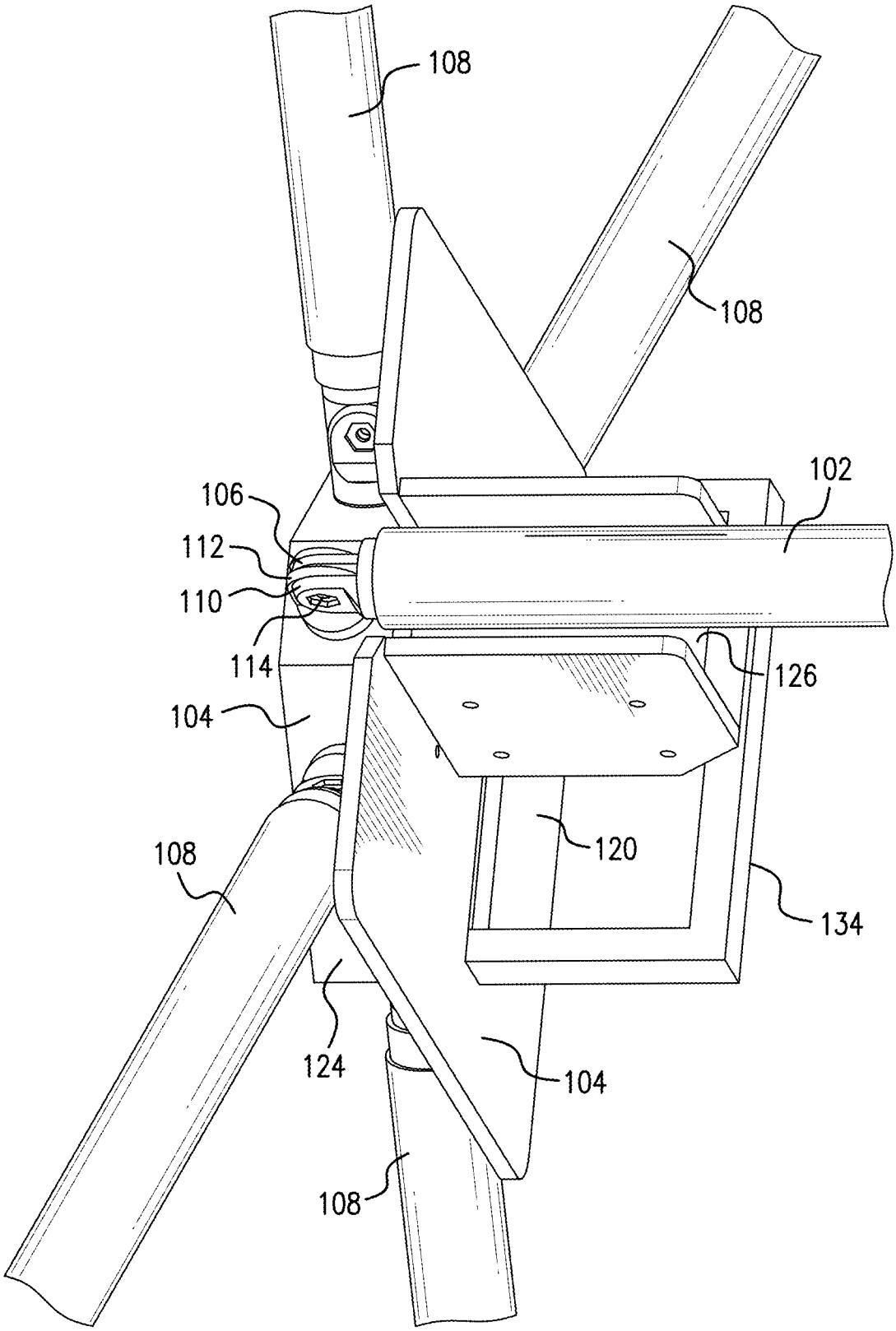
FIG. 3 is a close up view of the hub of the portable support mast in the erect position.
Figure 4:
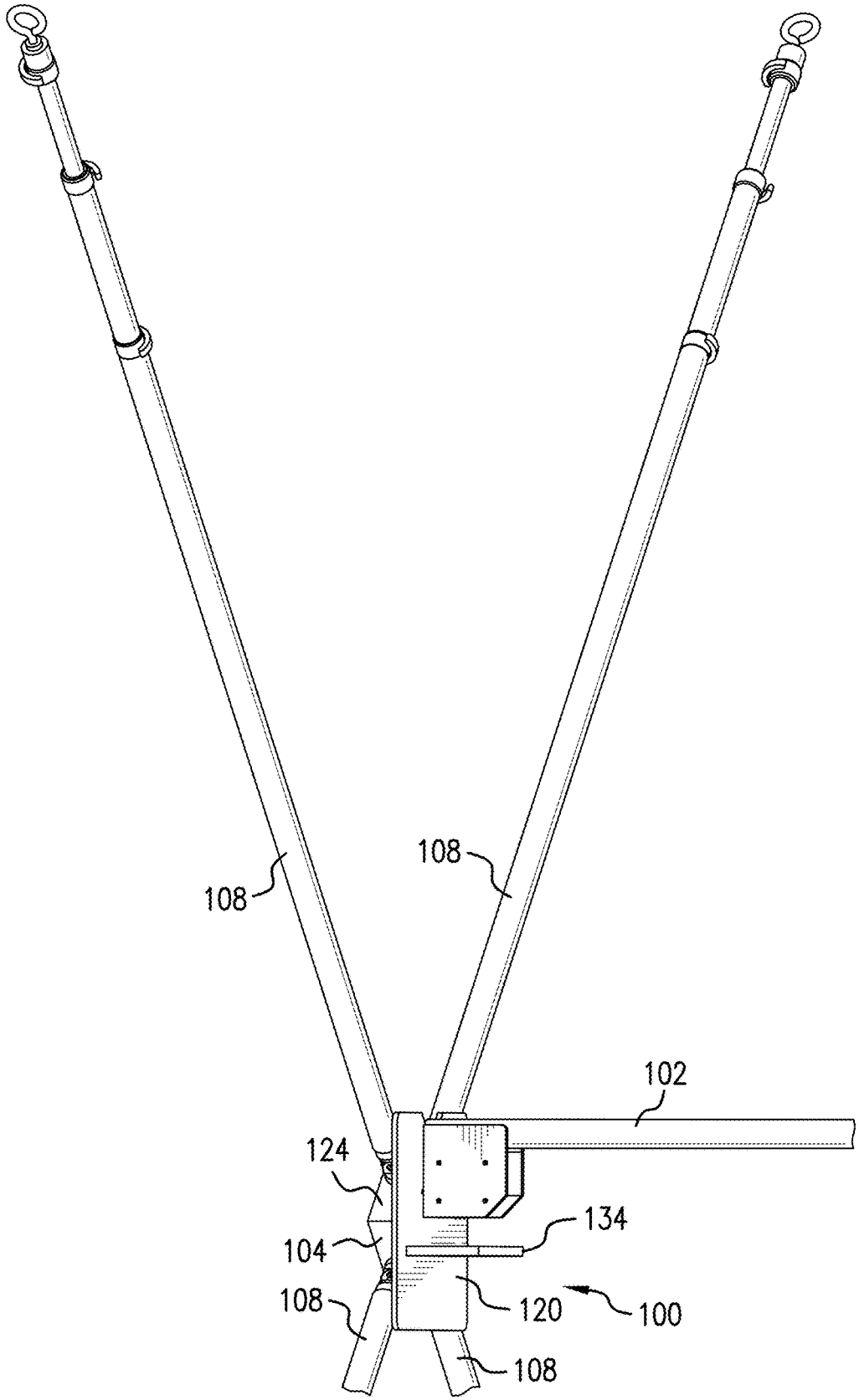
FIG. 4 is another illustration of the portable support mast in the erect position.

Referring to FIGS. 1-3 shown is a portable support mast 100 according to this disclosure. FIG. 1 shows portable support mast 100 in the stowed position and FIG. 2 shows portable support mast 100 in the erect position. Generally, a vertical member 102 supports the elevated load, which can be any object that needs to be elevated above the ground, for example, a radio antenna, camera, light, beacon, etc.

Vertical member 102 is connected to a hub 104 via a pivot joint 106. Also connected to hub 104 are three or more horizontal members 108 that can be pivoted to extend radially from hub 104. When each of vertical member 102 and horizontal members 108 are moved from their stowed position to the erect position, a free standing portable support mast 100 that elevates an object above the ground is provided. In the stowed position, portable support mast 100 has each of vertical member 102 and horizontal members 108 hanging below hub 104 so that it can be easily carried by a single person.

More specifically, portable support mast 100 comprises of hub 104 with a vertical member 102 pivotally attached to hub 104 for movement between a stowed position and an erect position. At least three horizontal members 108 are each pivotally attached to hub 104 for movement between a stowed position and an erect position. Each of vertical member 102 and horizontal members 108 are attached to hub by pivot joint 106 that can be implemented as a knuckle joint. Each end of vertical member 102 and horizontal members 108 has attached thereto a single eye member 110 and a knuckle 112 is attached to hub 104 with the two attached together by a pin 114. This allows each of vertical member 102 and horizontal members 108 to pivot or rotate between the respective stowed position and erect position. One skilled in the art will readily recognize that pivot joint 106 can be implemented in a wide variety of attachment mechanisms. While the illustrated embodiment is shown and described with a pivotal attachment, which is advantageous for keeping vertical member 102 and horizontal members 108 attached to hub 104, one skilled in the art will also recognize that vertical member 102 and horizontal members 108 can be stowed separately from hub 104 and attached for use.

Hub 104 comprises of a top surface 120, an opposite bottom surface 122 and a side surface 124. Side surface 124 can comprise a single continuous surface (e.g. round or oval) or three or more surfaces to create a triangular, square, pentagon, etc. shape. Each pivot joint 106 for the vertical member 102 and horizontal members 108 can be attached to hub 104 at its side surface 124. Top surface 120 of hub 104 can have extending portions that extend out above each pivot joint 106 for horizontal members 108 to provide a hard stop for the rotation of each horizontal member. For vertical member 102, a hub constraint 126 can be positioned on top surface 120 of hub 104 to provide a hard stop for the rotation of vertical member 102 and to support vertical member 102 in the erect position (see FIG. 2). This erect position can be substantially perpendicular to top surface 120 of hub 104. One skilled in the art will recognize that exactly perpendicular may be the desired position for vertical member 102 in the erect position but manufacturing tolerances and implementation procedures may cause vertical member 102 to deviate from perpendicular. Nevertheless, hub constraint 126 can be designed to prevent vertical member 102 from pivoting past the erect position.

The foregoing configuration gives hub 104 a mechanical zenith angle constraint for each vertical member 102 and horizontal members 108. Each of horizontal members 108 can be stowed at a −180 degree zenith angle and can be limited to no less than a −90 degree zenith angle. A −90 degree zenith angle is also defined as horizontal, and hence horizontal members 108 can never be pivoted toward vertical. This enables vertical member 102 and horizontal members 108 to pivot from a stowed position where they all hang parallel to each other and substantially 180 degrees from the erect position of vertical member 102. This is important to the structure and stability of the erected portable support mast 100. Vertical member 102 is pivoted from its −180 degree zenith stowed position to lie on the ground at a −90 degree zenith horizontal position while being extended and the load attached. Hub 104 constrains the zenith angle of vertical member 102 to 0 degrees (vertical) to prevent pivoting beyond vertical in the opposite direction and falling to the ground on the opposite side. Hub-constrained horizontal structural elements provide the opposing forces.

Each horizontal member 108 can comprise of an anchor 128 on an end opposite of hub 104. Similarly, vertical member 102 can comprise of a guy ring 130 on an end opposite of hub 104. A guy line 132 can be attached between guy ring 130 on vertical member 102 and anchor 128 on one of horizontal members 108. Additional guy lines 132 can be attached in the same manner between guy ring 130 on vertical member 102 and anchor 128 on one of horizontal members 108. With guy line 132 attached, portable support mast 100 is fully erected and stable. Weights may be placed at the outer ends of the horizontal members 108 for additional tipping protection of portable support mast 100 under severe wind loading conditions.

In an embodiment, as shown in FIG. 2 guy line 132 further comprises indications thereon, for example, indications A through D. The user extends the telescoping horizontal member 108 can adjust the length of guy line 132 at the desired height by simply drawing a tensioner 131 to the desired indication A through D. This allows guy line 132 to be quickly attached to horizontal member 108 and stretched tight.

Vertical structure 100 has a wind loading area determined by vertical member 102, guys line(s) 132, any cables or wiring routed from the ground to the load object, and the load object at the top of vertical member 102. Horizontal members 108 can be assumed to have no wind load because they can be configured to lie on the ground with an insignificant vertical profile. To avoid tipping of the erected portable support mast 100 due to horizontal wind load, the pivot point would lie along a line connecting the end of two horizontal members 108. In prior art, the tipping moment would be limited by the retention force of ground stakes and guy lines, and if a guy stake pulls out of the ground under stress, the structure would collapse in its entirety. Portable support mast 100, on the other hand, can have vertical member 102 and horizontal members 108 trussed by an inflexible guy line 132. Hence, only a sufficiently powerful wind force will cause the trussed portable support mast 100 to tip over on the horizontal end point axis with the top of vertical member 102 with its load resting on the ground.

Given a constant wind load of portable support mast 100 and its load, it can be shown by structural analysis that adding weight to each outer end of horizontal members 108 increases the wind force necessary to tip portable support mast 100. Such weights are typically in the range of 10-50 lbs., and may be sand bags, pieces of masonry, tires, logs, rocks, etc., or other field expedient materiel.

In its stored/carrying configuration, as shown in FIG. 1, the disclosed vertical structure 100 has structural members (vertical member 102 and horizontal members 108) pivoted and stowed in the −180 degree position relative to Earth zenith. In this configuration, the stored portable support mast 100 can be inserted into a carrying bag or case, or simply have the members immobilized for carrying convenience by a manner of circumferential strap. A handle 134 can also be provided on top surface 120 of hub 104 for ease of carrying.

The foregoing provides a portable support mast 100 that can be carried and erected by a single person. First, a flat square area is selected into which the designed horizontal members 108 will fit when extended. This may be on the ground, on a rooftop, etc. as desired but with a nominally flat surface compatible with horizontal members 108. The surface material is irrelevant as no stakes or other penetrations are required.

Next, horizontal members 108 and vertical member 102 are pivoted into the horizontal position with hub 104 resting on the ground. Horizontal members 108 and vertical member 102 are extended and secured. A typical means of securing the members is the use of integral single-lever compression clamp which constricts an outer slit tube tightly around an inner telescoping tube. The load is affixed to the top of vertical member 102. Any cables from the load to the ground are installed, and twisted around vertical member 102 or otherwise secured to it to prevent wind movement. The pre-marked guy lines 132 are installed at the top to a guy ring 130 of vertical member 102 to anchor 128 of horizontal member 108. Pre-marked guy lines are key to rapid erection. Because the end points of the horizontal members are known and fixed, the length of the guy lines is known a priori and can be set to the proper length, which assures the proper tension for walking the mast up without need of a person adjusting the tension while the mast is raised. Traditional staked guy lines have no precisely known length to allow presetting. Multiple guy lines 132 can be installed, with the last guy line 132 only attached to guy ring 130 and left lying on the ground but later attached to the last horizontal member 108 after vertical member 102 has been walked up to vertical position. The vertical member is walked up to the vertical position, with the person walking it up simultaneously loosely holding the last guy line 132. It can be good practice to orient vertical member 102 on the ground such that when it is walked up, any prevailing wind will be blowing in the direction of the walk-up. This gives each horizontal members 108 with a length commensurate with a height of vertical member 102 to provide wind stability.

When vertical member 102 is in the vertical position (at 0 degrees zenith angle) and against hub constraint 126, the person erecting portable support mast 100 uses the last guy line 132 to maintain tension and vertical position of vertical member 102 as he walks the line out to the end of the fourth (far) horizontal member 108 and clips it in place to its corresponding anchor 128. Weights may optionally be placed on/at the ends of each of horizontal members 108 for added wind stability.

Each of horizontal members 108 and vertical member 102 can be configured as telescoping to greatly expand the length of the respective horizontal members 108 and vertical member 102 from its stowed capacity. If vertical member 102 is implemented with telescoping sections with manually operated clamps, then the previously described walk-up erection sequence may be altered such that vertical member 102 in the non-extended position. The load can be attached to the top, all guy lines 132 can be attached at both ends, vertical member 102 can then be extended to the vertical position (0 degree zenith angle), and while manually holding vertical member 102 in the vertical position, the person can proceed to lift/extend and clamp each telescoping section of vertical member 102.

Preferably, horizontal members 108 and vertical member 102 are made of high-modulus material. The use of high bending modulus carbon fiber telescoping tubing, for example, produces a support structure with very light weight and very little bending as the vertical mast is walked up.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

We claim:

1. A portable support mast, comprising:

a hub comprising a top surface, an opposite bottom surface, and a side surface;

an extensible vertical member;

a first pivot joint attached to the side surface of the hub and the extensible vertical member in order to pivotally attach the extensible vertical member to the hub for movement between a stowed position and an erect position, wherein the vertical member pivots substantially 180 degrees from the stowed position to the erect position;

at least three extensible horizontal members;

at least three horizontal pivot joints attached to the side surface of the hub and each one of which attached to one of the at least three extensible horizontal members in order to pivotally attach the at least three extensible horizontal members to the hub for movement between a stowed position and an erect position, wherein the at least three extensible horizontal members and the extensible vertical member all hang parallel to each beneath the bottom surface of the hub in the stowed position.

2. The portable support mast of claim 1, and further comprising a limiting brace attached to the top surface of the hub and positioned substantially perpendicular to the top surface of the hub and adjacent to and touching a side of the extensible vertical member in the erect position and not touching the extensible vertical member in the stowed position to support the extensible vertical member in the erect position.

3. The portable support mast of claim 2, wherein the limiting brace prevents the extensible vertical member from pivoting past the erect position.

4. The portable support mast of claim 1, and further comprising a limiting brace attached to the top surface of the hub and positioned to limit the movement of the extensible horizontal members in the erect position which is substantially parallel to the top surface of the hub.

5. The portable support mast of claim 1, wherein each horizontal member has a length commensurate with a height of the vertical member to provide wind stability.

6. The portable support mast of claim 5, wherein each horizontal member is telescoping to extend the length.

7. The portable support mast of claim 6, wherein the vertical member is telescoping to extend the length.

8. The portable support mast of claim 6, wherein each horizontal member further comprises of an anchor on an end opposite of the hub.

9. The portable support mast of claim 8, wherein the vertical member further comprises of an anchor on an end opposite of the hub for attaching a guy line between the anchor on the vertical member and the anchor on the one of the horizontal members.

10. The portable support mast of claim 9, wherein the guy line further comprises a quick draw tensioner where the guy line is configured to go through and out the quick draw tension so that the tensioner can be moved up and down the guy line to quickly adjust the tension on the guy line.

11. The portable support mast of claim 1, wherein the vertical member and each of the horizontal members comprises of carbon material.

12. The portable support mast of claim 1, wherein the hub comprises of a top surface, an opposite bottom surface and a side surface, and further comprising a handle on the top surface of the hub.

13. The portable support mast of claim 1, where in the vertical member is configured for attaching an antenna to the top.

14. The portable support mast of claim 1, wherein the vertical member and the horizontal members are each extensible by telescoping sub-members with a compression clamp which constricts an outer one of two telescoping sub-members to an inner one of two telescoping sub-members.

15. The portable support mast of claim 1, wherein the vertical member and the horizontal members are each extensible by telescoping sub-members such that a ratio of the extensible length of the vertical member to the extensible length of the horizontal members is adjustable for required stability in high wind applications.

* * * * *